US009607476B2

(12) United States Patent
Nauman et al.

(10) Patent No.: US 9,607,476 B2
(45) Date of Patent: Mar. 28, 2017

(54) WAGERING GAME HAVING MYSTERY-SYMBOL REVEAL SCHEME

(71) Applicant: WMS Gaming Inc., Waukegan, IL (US)

(72) Inventors: Jeffry L. Nauman, Yorkville, IL (US); Dion K. Aoki, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 371 days.

(21) Appl. No.: 14/484,403

(22) Filed: Sep. 12, 2014

(65) Prior Publication Data

US 2015/0080106 A1 Mar. 19, 2015

Related U.S. Application Data

(60) Provisional application No. 61/878,312, filed on Sep. 16, 2013.

(51) Int. Cl.
*G07F 17/32* (2006.01)
*G07F 17/34* (2006.01)

(52) U.S. Cl.
CPC ..... *G07F 17/326* (2013.01); *G07F 17/34* (2013.01)

(58) Field of Classification Search
CPC ..... G07F 17/326; G07F 17/34
See application file for complete search history.

(56) References Cited

U.S. PATENT DOCUMENTS

| | | | |
|---|---|---|---|
| 5,209,479 | A | 5/1993 | Nagao et al. |
| 6,190,254 | B1 | 2/2001 | Bennett |
| 6,375,570 | B1 | 4/2002 | Poole et al. |
| 6,517,433 | B2 | 2/2003 | Loose et al. |
| 6,676,512 | B2 | 1/2004 | Fong et al. |
| 7,029,396 | B2 | 4/2006 | Jaffe et al. |
| 7,115,033 | B1 | 10/2006 | Timperley |
| 7,226,359 | B2 | 6/2007 | Bussick et al. |
| 7,351,144 | B2 | 4/2008 | Daly |
| 7,758,414 | B1 | 7/2010 | Marks et al. |
| 8,002,625 | B2 | 8/2011 | Maya |
| 8,096,869 | B2 | 1/2012 | Yoshimi |
| 8,105,145 | B2 | 1/2012 | Jaffe |
| 8,371,928 | B2 | 2/2013 | Englman et al. |

(Continued)

FOREIGN PATENT DOCUMENTS

| | | |
|---|---|---|
| AU | 21918/88 | 4/1989 |
| AU | 2004/203045 | 7/2004 |

(Continued)

*Primary Examiner* — Werner Garner

(74) *Attorney, Agent, or Firm* — Nixon Peabody LLP

(57) ABSTRACT

A gaming system includes a plurality of simulated reels. Each reel has a plurality of symbol positions, including first symbol positions with reel symbols thereon and second symbol positions with initially transparent regions. The gaming system selects one of the reel symbols to serve as a background symbol, displays a game outcome region through which the simulated reels move, and while the simulated reels are moving, reveals the background symbol through the initially transparent regions of the second symbol positions that move through the game outcome region. For each simulated reel that has stopped moving, each of the second symbol positions located within the game outcome region are filled with the reel symbol corresponding to the background symbol. An award is provided based on the symbols in the game outcome region.

28 Claims, 12 Drawing Sheets

(56) References Cited

U.S. PATENT DOCUMENTS

| | | | |
|---|---|---|---|
| 8,376,832 | B2 | 2/2013 | O'Connor et al. |
| 8,469,797 | B2 | 6/2013 | Collette et al. |
| 2002/0123378 | A1 | 9/2002 | Bucknall et al. |
| 2003/0064779 | A1 | 4/2003 | Suda |
| 2006/0264254 | A1 | 11/2006 | Aoki |
| 2007/0060261 | A1 | 3/2007 | Gomez |
| 2008/0188280 | A1 | 8/2008 | Marks et al. |
| 2008/0188286 | A1 | 8/2008 | Jaffe |
| 2009/0227356 | A1 | 9/2009 | Moroney |
| 2009/0253491 | A1 | 10/2009 | Gomez et al. |
| 2010/0016054 | A1 | 1/2010 | Berman et al. |
| 2010/0016061 | A1 | 1/2010 | Gomez et al. |
| 2010/0062196 | A1 | 3/2010 | Bezek et al. |
| 2010/0062829 | A1 | 3/2010 | Chan |
| 2010/0093422 | A1 | 4/2010 | Gomez |
| 2010/0190544 | A1 | 7/2010 | Thomas |
| 2010/0197377 | A1 | 8/2010 | Aoki et al. |
| 2010/0210343 | A1 | 8/2010 | Englman et al. |
| 2010/0234099 | A1 | 9/2010 | Rasmussen et al. |
| 2010/0248811 | A1 | 9/2010 | Jaffe et al. |
| 2013/0017881 | A1 | 1/2013 | Watkins |
| 2013/0084937 | A1 | 4/2013 | Vann |
| 2013/0184045 | A1 | 7/2013 | Vermaak et al. |

FOREIGN PATENT DOCUMENTS

| | | |
|---|---|---|
| AU | 2004/200033 | 6/2010 |
| EP | 0558307 | 9/1993 |
| GB | 2097160 | 10/1982 |
| GB | 2117952 | 10/1983 |

| Position | Reel Strips | | | | |
|---|---|---|---|---|---|
| | 62a | 62b | 62c | 62d | 62e |
| 0 | H2 | M1 | L2 | M3 | L2 |
| 1 | L2 | M2 | L3 | L1 | H1 |
| 2 | H3 | H2 | M2 | H1 | L1 |
| 3 | L1 | L1 | M4 | M2 | L4 |
| 4 | WILD | WILD | WILD | WILD | WILD |
| 5 | L4 | L3 | M1 | L4 | H1 |
| 6 | L3 | M2 | H2 | M4 | L1 |
| 7 | M3 | L4 | L2 | M1 | M4 |
| 8 | M1 | M4 | L1 | L3 | L3 |
| 9 | L2 | H1 | H3 | M3 | M1 |
| 10 | L4 | L4 | L3 | H3 | L4 |
| 11 | M4 | L1 | L2 | L2 | H2 |
| 12 | L1 | M2 | H3 | M4 | L3 |
| 13 | L2 | L4 | L1 | H3 | H3 |
| 14 | M1 | L3 | M3 | L3 | M3 |
| 15 | L3 | M3 | M4 | L2 | L1 |
| 16 | M3 | M4 | M2 | L1 | L3 |
| 17 | L2 | L4 | L3 | TRNSP4 | TRNSP5 |
| 18 | L3 | L2 | L4 | TRNSP4 | TRNSP5 |
| 19 | TRNSP1 | TRNSP2 | TRNSP3 | TRNSP4 | TRNSP5 |
| 20 | TRNSP1 | TRNSP2 | TRNSP3 | TRNSP4 | TRNSP5 |
| 21 | TRNSP1 | TRNSP2 | TRNSP3 | TRNSP4 | TRNSP5 |
| 22 | TRNSP1 | TRNSP2 | TRNSP3 | TRNSP4 | TRNSP5 |
| 23 | TRNSP1 | TRNSP2 | TRNSP3 | TRNSP4 | TRNSP5 |
| 24 | TRNSP1 | TRNSP2 | TRNSP3 | TRNSP4 | TRNSP5 |
| 25 | TRNSP1 | TRNSP2 | TRNSP3 | TRNSP4 | TRNSP5 |
| 26 | TRNSP1 | TRNSP2 | TRNSP3 | TRNSP4 | TRNSP5 |
| 27 | TRNSP1 | TRNSP2 | TRNSP3 | TRNSP4 | TRNSP5 |
| 28 | TRNSP1 | TRNSP2 | TRNSP3 | TRNSP4 | TRNSP5 |
| 29 | TRNSP1 | TRNSP2 | TRNSP3 | TRNSP4 | TRNSP5 |
| 30 | L2 | L4 | L3 | L2 | L1 |
| 31 | L3 | L2 | L4 | L1 | L3 |
| 32 | H3 | L3 | M4 | H1 | H3 |
| 33 | L4 | M4 | M1 | H2 | M2 |
| 34 | L2 | L4 | L3 | L2 | L1 |
| 35 | L3 | L2 | L1 | L1 | L3 |
| 36 | BONUS | BONUS | BONUS | BONUS | BONUS |
| 37 | L2 | L4 | L3 | L2 | L1 |
| 38 | L3 | L2 | L1 | L1 | L3 |
| 39 | M3 | H3 | H1 | M4 | H3 |
| 40 | L1 | M2 | M2 | M2 | M2 |
| 41 | H1 | L4 | L3 | L4 | M4 |
| 42 | L3 | M4 | L1 | H3 | H1 |
| 43 | M2 | M2 | M1 | L1 | L2 |
| 44 | M1 | L1 | H3 | M2 | M2 |

70 70 70 70 70

FIG. 4

WAGERING GAME HAVING MYSTERY-SYMBOL REVEAL SCHEME

CROSS-REFERENCE TO RELATED APPLICATIONS

This application claims the benefit of and priority to U.S. Provisional Patent Application No. 61/878,312 titled "Wagering Game Having Mystery-Symbol Reveal Scheme" and filed on Sep. 16, 2013, which is incorporated herein by reference in its respective entirety.

COPYRIGHT

A portion of the disclosure of this patent document contains material which is subject to copyright protection. The copyright owner has no objection to the facsimile reproduction by anyone of the patent disclosure as it appears in the U.S. Patent and Trademark Office patent files or records, but otherwise reserves all copyright rights whatsoever.

TECHNICAL FIELD

The present disclosure relates generally to wagering games, as well as wagering game terminals and wagering game systems. More particularly, the present disclosure relates to systems, methods, and devices for altering one or more of the plurality of reels of the wagering game.

BACKGROUND

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One way that players may experience a heightened entertainment level while playing the wagering game is when the player senses that he or she has a better chance of achieving a winning outcome. Because the player is typically focused on the display on which the wagering game is being played, providing visual indicators that a winning outcome player is more likely to be achieved in the wagering game can be influential in attracting new players and maintaining existing players. The present invention is directed to providing a specific type of visual indicator for a slots-based wagering game that uses a background symbol located behind the moving simulated reels of the slots-based wagering game.

SUMMARY

One aspect of the present invention relates to a gaming system includes a gaming cabinet, a random element generator, one or more controllers, an electronic display device, and an electronic input device. The gaming cabinet houses components associated with the casino wagering game. The electronic display device is disposed on the gaming cabinet. The electronic input device is disposed on the gaming cabinet. The electronic input device is configured to receive a physical input from a player to initiate the casino wagering game and transform the input into an electronic data signal. The random element generator is configured to generate one or more random elements. The one or more controllers are configured to: (i) initiate the casino wagering game in response to the electronic data signal from the electronic input device; (ii) determine an outcome of the casino wagering game based, at least in part, on the one or more random elements; (iii) direct the electronic display device to display a background and a game outcome region superimposed over the background, the game outcome region being formed by a plurality of simulated reels, each reel including a respective plurality of first positions and at least one of the reels including a respective plurality of second positions, the first positions being occupied by respective symbols, the second positions being initially transparent; (iv) randomly select a symbol from a plurality of possible symbols to be a background symbol that occupies the background; (v) spin the plurality of simulated reels such that at least a portion of the selected background symbol is revealed through the initially transparent second positions as the initially transparent second positions spin through the game outcome region; (vi) stop the plurality of simulated reels; (vii) after stopping the plurality of simulated reels, direct the electronic display device to display the selected background symbol at each second position that is in the game outcome region when the reels are stopped; and (viii) award a tangible award based on the symbols in the game outcome region.

In another aspect the gaming system includes a gaming cabinet, a random element generator, one or more controllers, an electronic display device, and an electronic input device. The gaming cabinet houses components associated with the casino wagering game. The electronic display device is disposed on the gaming cabinet. The electronic input device is disposed on the gaming cabinet. The electronic input device is configured to receive a physical input from a player to initiate the casino wagering game and transform the input into an electronic data signal. The electronic display device includes a plurality of simulated reels having a plurality of symbol positions. The plurality of symbol positions includes first symbol positions with reel symbols thereon and second symbol positions with initially transparent regions. The one or more controllers are configured to (i) initiate the casino wagering game in response to the electronic data signal from the electronic input device; (ii) determine an outcome of the casino wagering game based, at least in part, on the one or more random elements; (iii) select one of the reel symbols to serve as a background symbol; (iv) direct the electronic display device to display a game outcome region through which the plurality of simulated reels move; (v) while the simulated reels are moving, reveal, on the electronic display device, the background symbol through the initially transparent regions of the second symbol positions that move through the game outcome region; (vi) for each of the plurality of simulated reels that have stopped moving, fill each of the second symbol positions located within the game outcome region with the reel symbol corresponding to the background symbol; and (vii) award a tangible award based on the symbols in the game outcome region.

In another aspect, the present invention is a gaming system for playing a wagering game having a plurality of simulated reels, and a method for operating the gaming system. Each of the reels has a plurality of symbol positions. The plurality of symbol positions includes first symbol positions with reel symbols thereon and second symbol positions with initially transparent regions. The gaming system comprises one or more display devices, one or more controllers, and one or more memory devices storing instructions. When executed by at least one of the one or more controllers, the instructions cause the gaming system to (i) select a symbol from a plurality of possible symbols to be a background symbol that occupies the background, (ii) display the selected background symbol behind the plurality of simulated reels within the game outcome region, (iii) spin the plurality of simulated reels such that at least a portion of the selected background symbol is revealed through the initially transparent second symbol positions as the initially transparent second symbol positions spin through the game outcome region, (iv) for each of the simulated reels that have stopped, fill each of the second symbol positions located within the game outcome region with the reel symbol corresponding to the selected background symbol, and (v) after all of the reels have stopped, provide an award based on the symbols in the game outcome region.

In yet a further aspect, the present invention is a gaming system and a method of operating a gaming system having a plurality of simulated reels. Each of the reels has a plurality of symbol positions. The gaming system is in communication with one or more controllers. The method comprises (i) selecting, via at least one of the one or more controllers, a symbol located on one of the plurality of reels to be the background symbol, (ii) displaying, on a video display device, the selected background symbol behind a game outcome region, (iii) displaying, within the game outcome region on the video display device, the plurality of simulated reels in movement and superimposed over the displayed background symbol such that only portions of the displayed background symbol are revealed to the player through transparent symbol positions located on the plurality of simulated reels, (iv) filling, via at least one of the one or more controllers, the transparent symbol positions located within the game outcome region with the reel symbol corresponding to the background symbol, and (v) awarding, by at least one of the one or more controllers, an award based on the filled reel symbols in the game outcome region.

The above summary is not intended to represent each embodiment or every aspect of the present disclosure. Rather, the summary merely provides an exemplification of some of the novel features presented herein. The above features and advantages, and other features and advantages of the present disclosure, will be readily apparent from the following detailed description of exemplary embodiments and best modes for carrying out the present invention when taken in connection with the accompanying drawings and the appended claims.

BRIEF DESCRIPTION OF THE DRAWINGS

FIG. 4 sets forth a diagrammatic illustration of the symbol positions and associated symbols on the reel strips used for the simulated reels of the wagering game that is played on the gaming terminal, gaming device, and/or gaming system according to the present invention.

Figure 1:
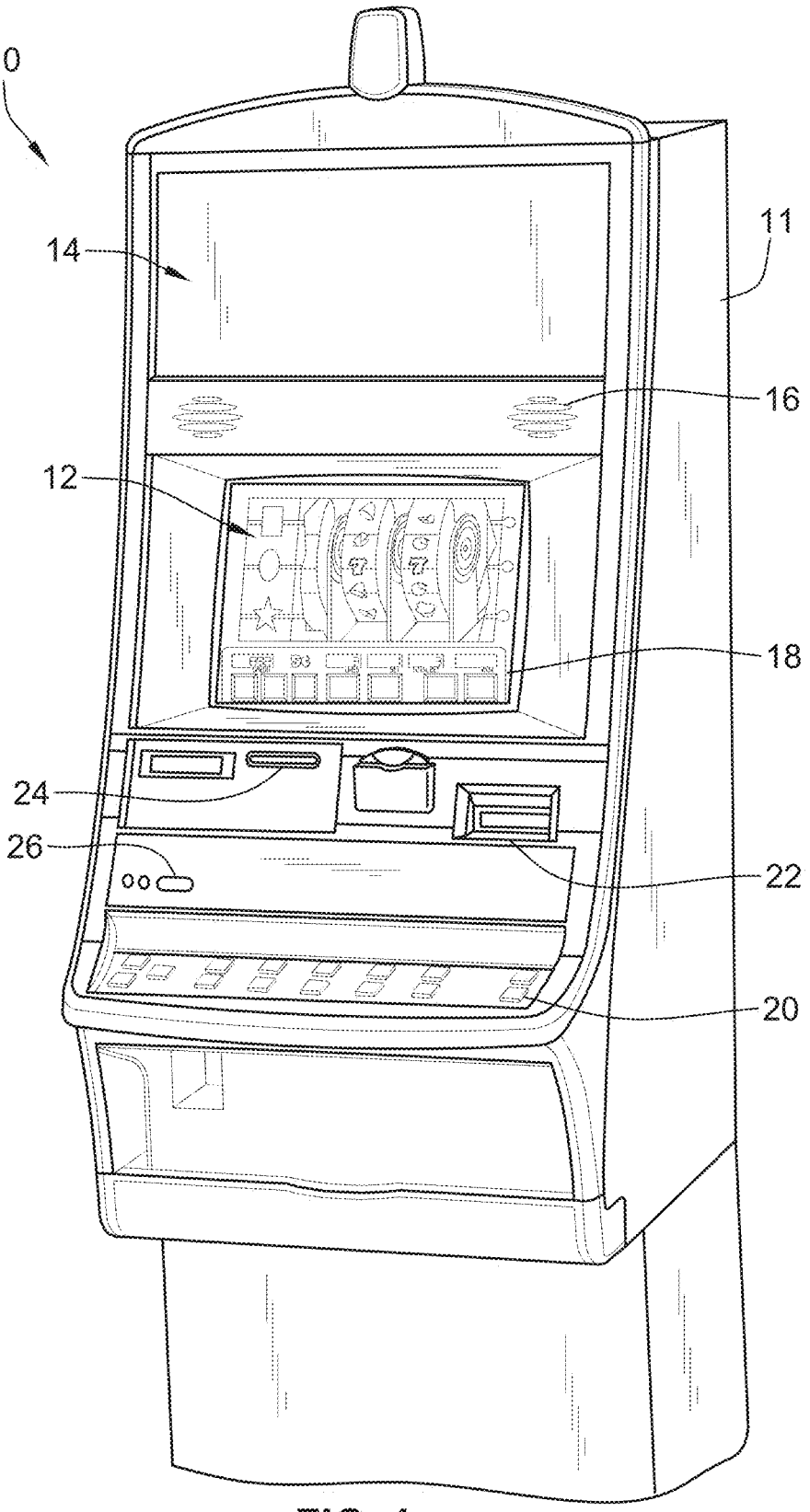
FIG. 1 (PRIOR ART)
FIG. 1 is a perspective-view illustration of an exemplary free-standing gaming terminal according to aspects of the present disclosure.

While aspects of this disclosure are susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering games," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game may involve wagers of real money, as found with typical land-based or on-line casino games. In other embodiments, the wagering game may additionally, or alternatively, involve wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1, there is shown a gaming terminal 10 similar to those used in gaming establishments, such as casinos. With regard to the present invention, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models as shown, handheld mobile units, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433, titled "Reel Spinning Slot Machine With Superimposed Video Image," U.S. Patent Application Publication Nos. US2010/0069160, titled "Handheld Wagering Game Machine And Docking Unit," and US2010/0234099, titled "Wagering Game System With Docking Stations" which are incorporated herein by reference in their entireties.

The gaming terminal 10 illustrated in FIG. 1 comprises a cabinet 11 that may house various input devices, output devices, and input/output devices. By way of example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming terminal 10. The gaming terminal 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Figure 2:
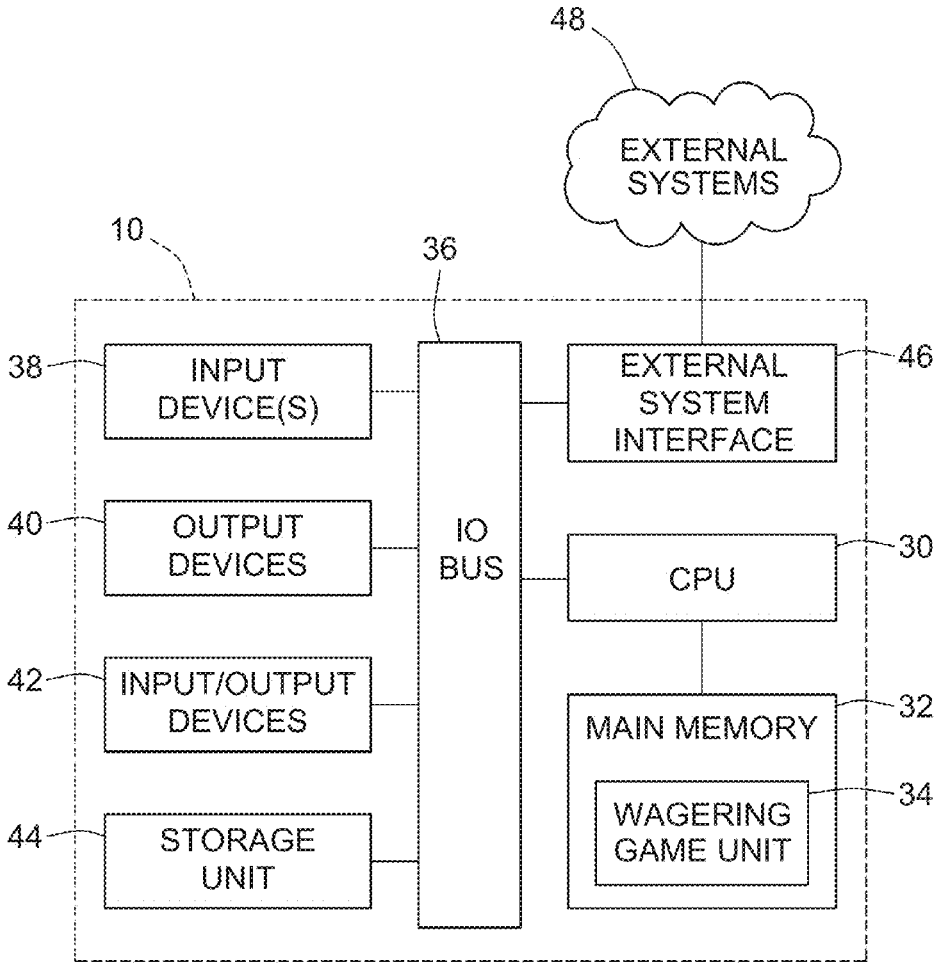
FIG. 2 (PRIOR ART)
FIG. 2 is a schematic diagram of an example of a gaming system according to aspects of the present disclosure.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
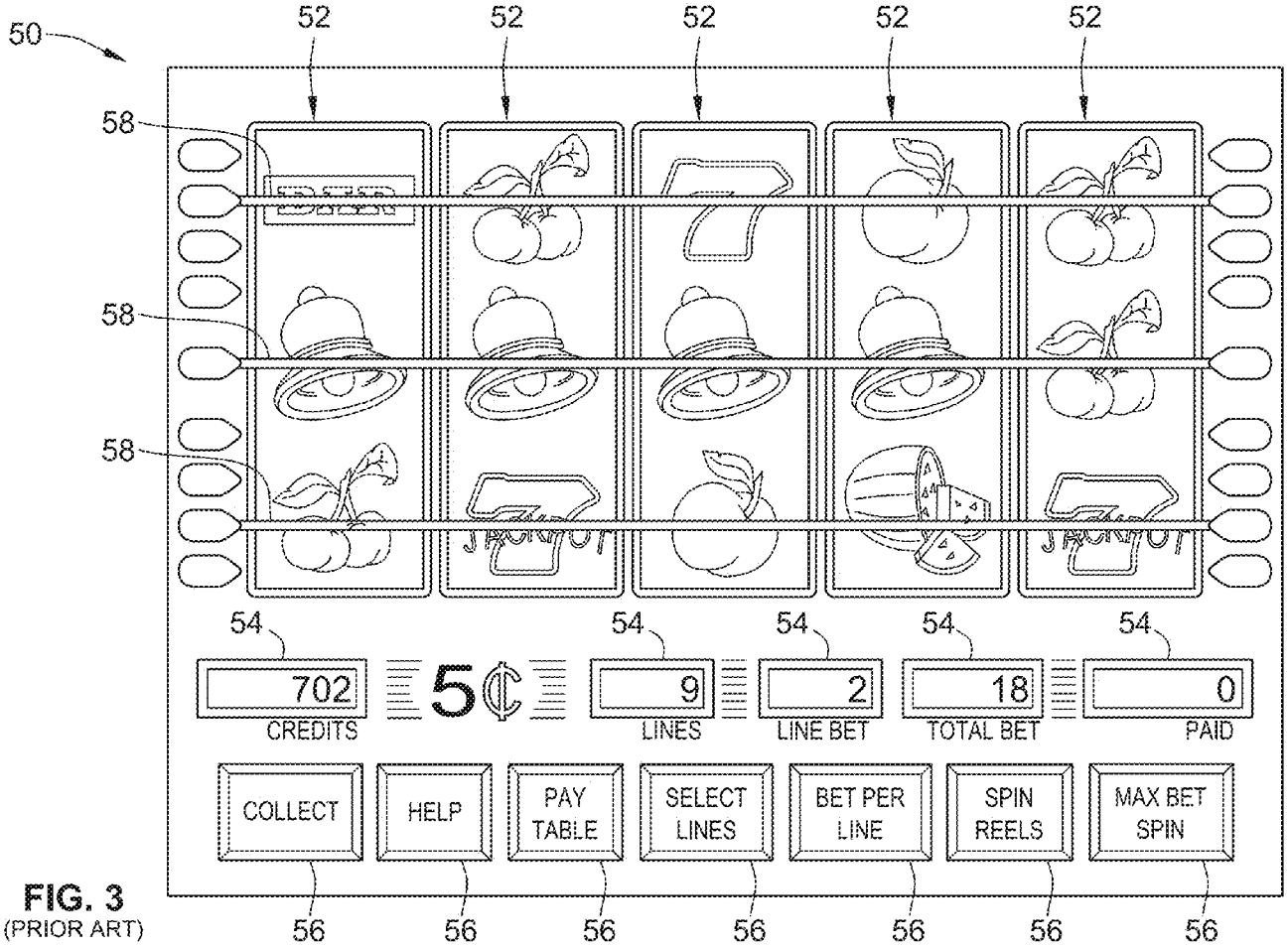
FIG. 3 (PRIOR ART)
FIG. 3 is a screen shot of a representative basic-game screen of a wagering game displayed on a gaming terminal, gaming device, and/or gaming system according to aspects of the present disclosure.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

In response to receiving an input indicative of a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

FIG. 4 provides a diagrammatic illustration of reel strips 62*a*, 62*b*, 62*c*, 62*d*, and 62*e* that would be used on the five reels 52 for playing a wagering game. Each of the reel strips 62*a*-62*e* contains forty-four (44) symbol positions. However, the present invention contemplates that the reel strips 62*a*-62*e* may have more symbol positions or less symbol positions, and that one or more of the five reel strips 62*a*-62*e* may have a different number of symbol positions than the remaining reel strips 62. In the illustrated embodiment, most of the symbol positions are associated with fixed symbols that, for purposes of simplicity, are shown as alphanumeric symbols (e.g., H1, L2, L4, M1, etc.). The reel strips 62*a*-62*e* may also include other types of symbols, such as "WILD" symbols and "BONUS" symbols in varying numbers and locations.

Additionally, each of the reel strips 62*a*-62*e* in FIG. 4 includes adjacent symbol positions that are "transparent" symbol positions 70 in that there is no symbol in that region. On each of the first reel strip 62*a*, the second reel strip 62*b*, and the third reel strip 62*c*, there are eleven transparent symbol positions 70 ("TRNSP1", "TRNSP2", "TRNSP3", respectively). On each of the fourth reel strip 62*d* and the fifth reel strip 62*e*, there are thirteen transparent symbol positions 70 ("TRNSP4", "TRNSP5", respectively). The number and location of the transparent symbol positions 70 can be altered. For example, each of the reel strips 62*a*-62*e* could have a different number of transparent symbol positions 70. Alternatively, multiple groupings or "clumps" of transparent symbol positions 70 could be present at different positions within each of the reel strips 62*a*-62*e*. As just one example, the first reel strip 62*a* could have a transparent symbol position 70 ("TRNSP1") at symbol positions 1, 10-15, 30-40 and normal fixed reel symbols at the remaining symbol positions 2-9, 16-29, and 41-44. Preferably, on at least some portions of the reel strips 62, the number of adjacent transparent symbol positions 70 is the same as or greater than the number of symbol positions that are present within the game outcome region on the primary display 12. As will be explained in more detail below, the transparent symbol positions 70 allow for an underlying background symbol within the display region to be revealed to the player such that the transparent symbol positions 70 serve to provide a "window" function for the player.

Figure 5:
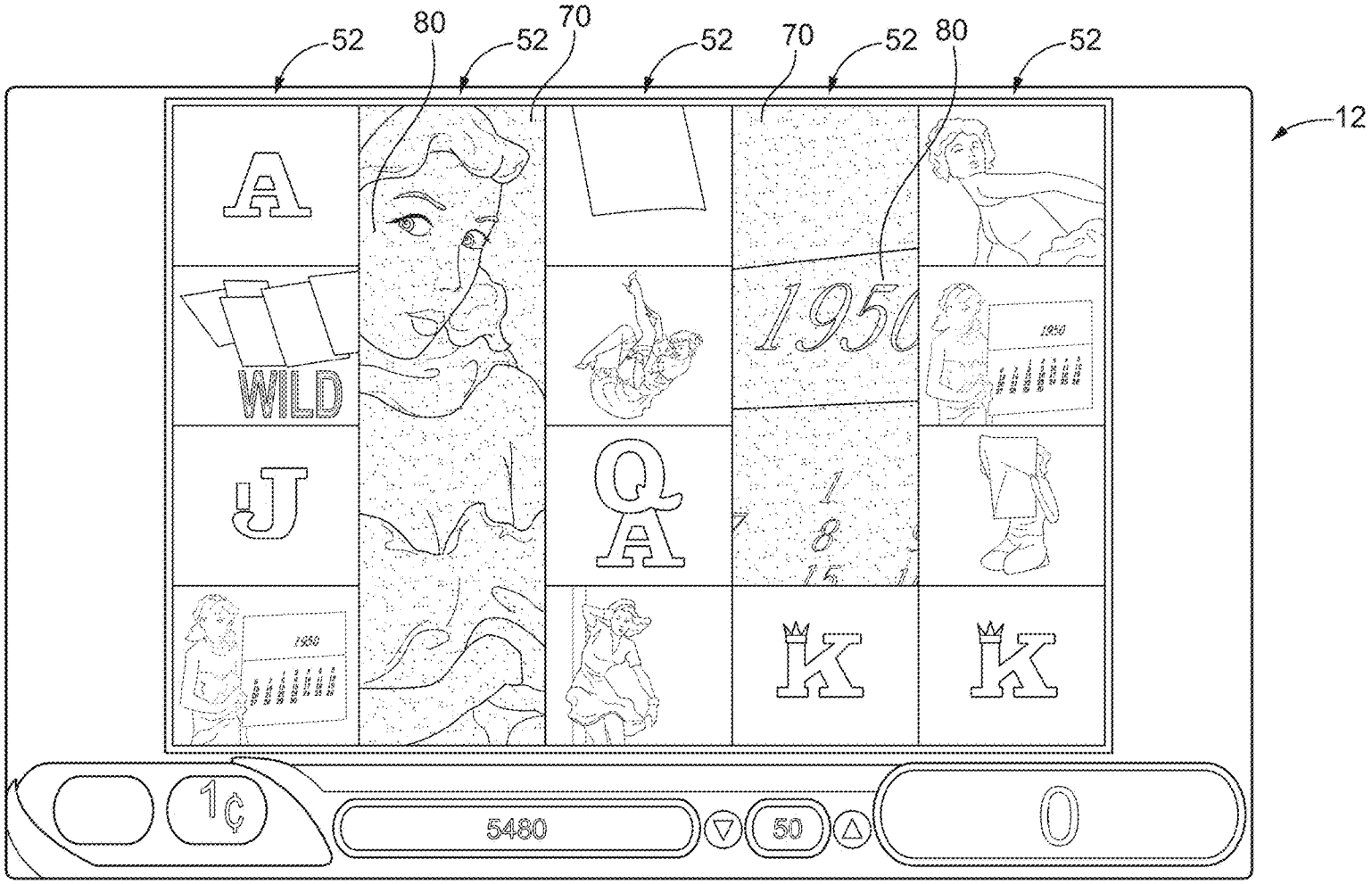
FIG. 5 is a screen shot of the display region of the wagering game that utilizes simulated reels having reel strips like those in FIG. 4.

In FIGS. 5-11, to better explain the utility of these transparent symbol positions 70, the alphanumeric symbols (e.g., H1, L2, L4, M1, etc.) have been replaced by more traditional symbols such that the reels 52 are now indicative of a "Calendar Girl" game theme. Of course, other kinds of symbols could be used with the present invention. Referring initially to FIG. 5, the reels 52 are placed in motion within a game outcome region of the primary display 12. In addition to the game outcome region, the primary display 12 may have other regions for providing information related to the rules of the game, player information, credits, wager amounts, etc. As shown, the game outcome region has a height of four symbol positions, such that a 5×4 array of symbols is present within the game outcome region. On the second and fourth reels 52, the reel strips 62*b* and 62*d* are in positions such that the transparent symbol positions 70 are moving through the game outcome region. When this occurs, portions of a large background symbol 80 are revealed within the game outcome region through the transparent symbol positions 70. In FIG. 5, the background symbol 80 is a "Woman-Holding-Calendar" symbol. For purposes of better distinguishing the transparent symbol positions 70 from the other symbols on the reels 52 in FIGS. 5-11, the background symbol 80 is shown as being slightly shaded. In the actual working device, shading is not necessarily required.

The background symbol 80 is a symbol that is typically randomly selected from a group of symbols. In one embodiment, the group of symbols from which the background symbol 80 is selected includes a subset of (or all of) the symbols that are typically present on the reel strips 62 of the reels 52. For example, with reference back to FIG. 4, the background symbol could be selected from a subset comprised of only the H1, H2, L2, L4, M1, M2, and M3 symbols. Alternatively, the background symbol 80 could be selected from any of the symbols present on the reel strips 62*a*-62*e*, including the "WILD" symbol and the "BONUS" symbol. When the "BONUS" symbol is selected for the background symbol 80, the player's chances of achieving a bonus game are increased by whichever bonus-triggering methodology (e.g., payline trigger, a scatter trigger, etc.) is utilized in the wagering game. In another embodiment, the background symbol 80 is selected from a subset of reel symbols that are considered to be the more beneficial symbols from the perspective of the player. In a further embodiment, the background symbol 80 is selected from the group of symbols that include symbols not present on the reels 52. However, the symbols not present on the reels 52 correspond to symbols present on the reels 52 such that the player understands the relationship. As an example, for a sports-theme wagering game in which the symbols on the reels 52 include "BALL" symbols from various sports, a background symbol 80 of a football player would correspond to a "FOOTBALL" symbol on the reels 52. Typically, a random number generator (usually involving one or more of the processors in the gaming system, such as CPU 30 in FIG. 2) is used to select the symbol that will be the background symbol 80 for a play of the wagering game.

Figure 6:
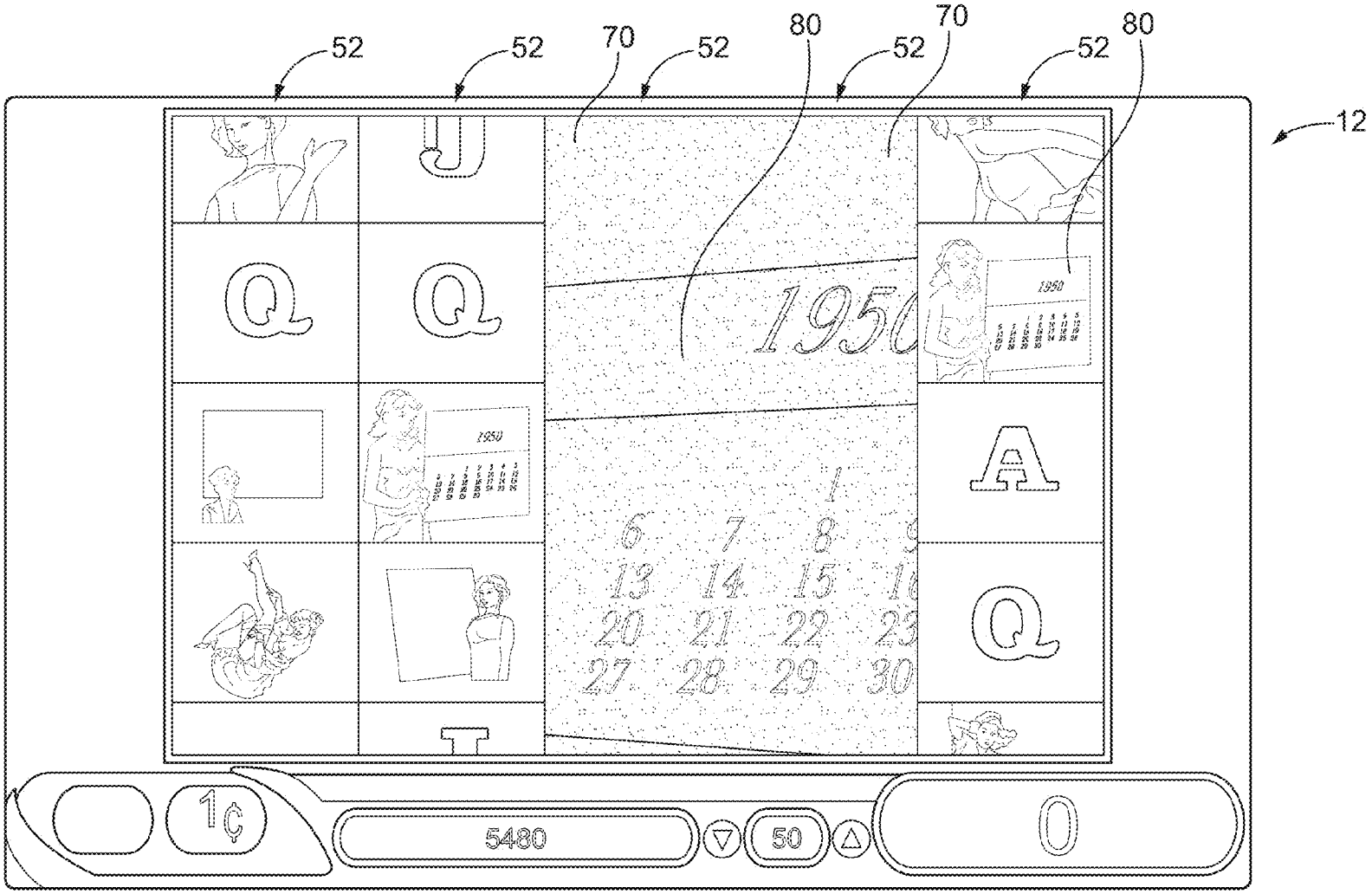
FIG. 6 is a screen shot of the display region of the wagering game that occurs after the screen shot of FIG. 5.

FIG. 6 is a subsequent screen shot relative to FIG. 5 in that the reels 52 continue their movement through the game outcome region of the primary display 12. On the third and fourth reels 52, the reel strips 62*c* and 62*d* are now in positions such that the transparent symbol positions 70 are located within the game outcome region. Relative to FIG. 5, a different portion of the background symbol 80 ("Woman-Holding-Calendar" symbol) is revealed to the player within the game outcome region. In the embodiment shown in FIG. 6, the symbol positions associated with transparent symbol positions 70 on the third and fourth reels 52 are transparent throughout their entire areas (i.e., there are no symbol position borders or frames), resulting in a single, large transparent "window" that encompasses the entire third and fourth reels 52.

Figure 7:
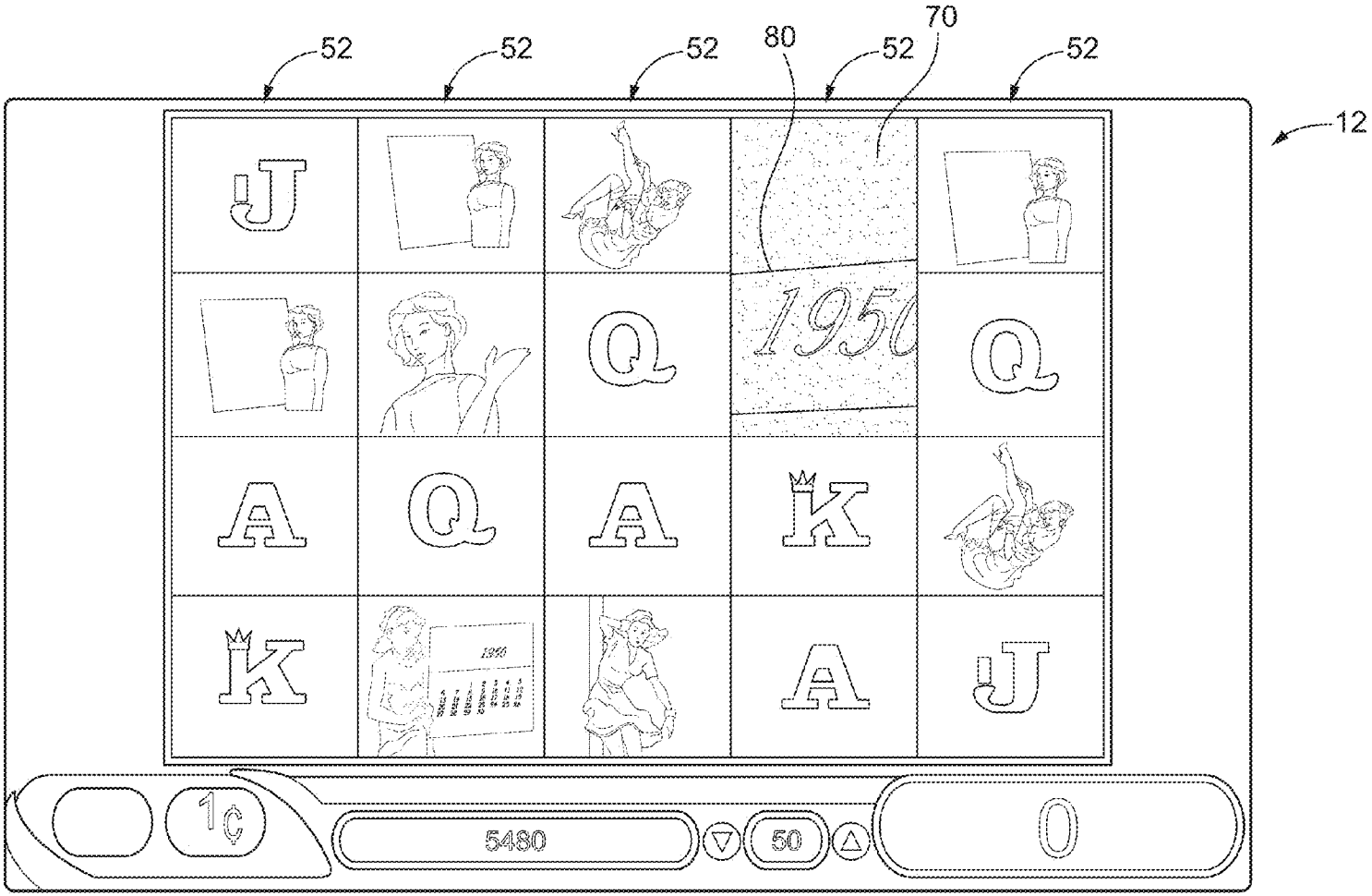
FIG. 7 is a screen shot of the display region of the wagering game that occurs after the screen shots of FIGS. 5 and 6.

FIG. 7 is a subsequent screen shot of the same game play relative to FIG. 6, except that the reels 52 have now stopped their movement through the game outcome region of the primary display 12. Typically, the reels 52 stop in a sequential order starting with the first reel 52 on the left and ending with the fifth reel 52 on the right. The top two symbol positions on the reel strip 62*d* of the fourth reel 52 are positioned such that two transparent symbol positions 70 allow for a smaller portion (relative to FIGS. 5-6) of the background symbol 80 to be revealed. Because all five reels 52 have transparent symbol positions 70 that move through the game outcome region within the primary display 12, by the time the reels 52 have completely stopped, the player should have an idea of the identity of the background symbol 80 because portions of it have been sporadically revealed to the player via the moving transparent symbol positions 70 on the five reels 52. As explained above, these transparent symbol positions 70 serve a "window" function because they permit the player to visualize the background symbol 80.

Figure 8:
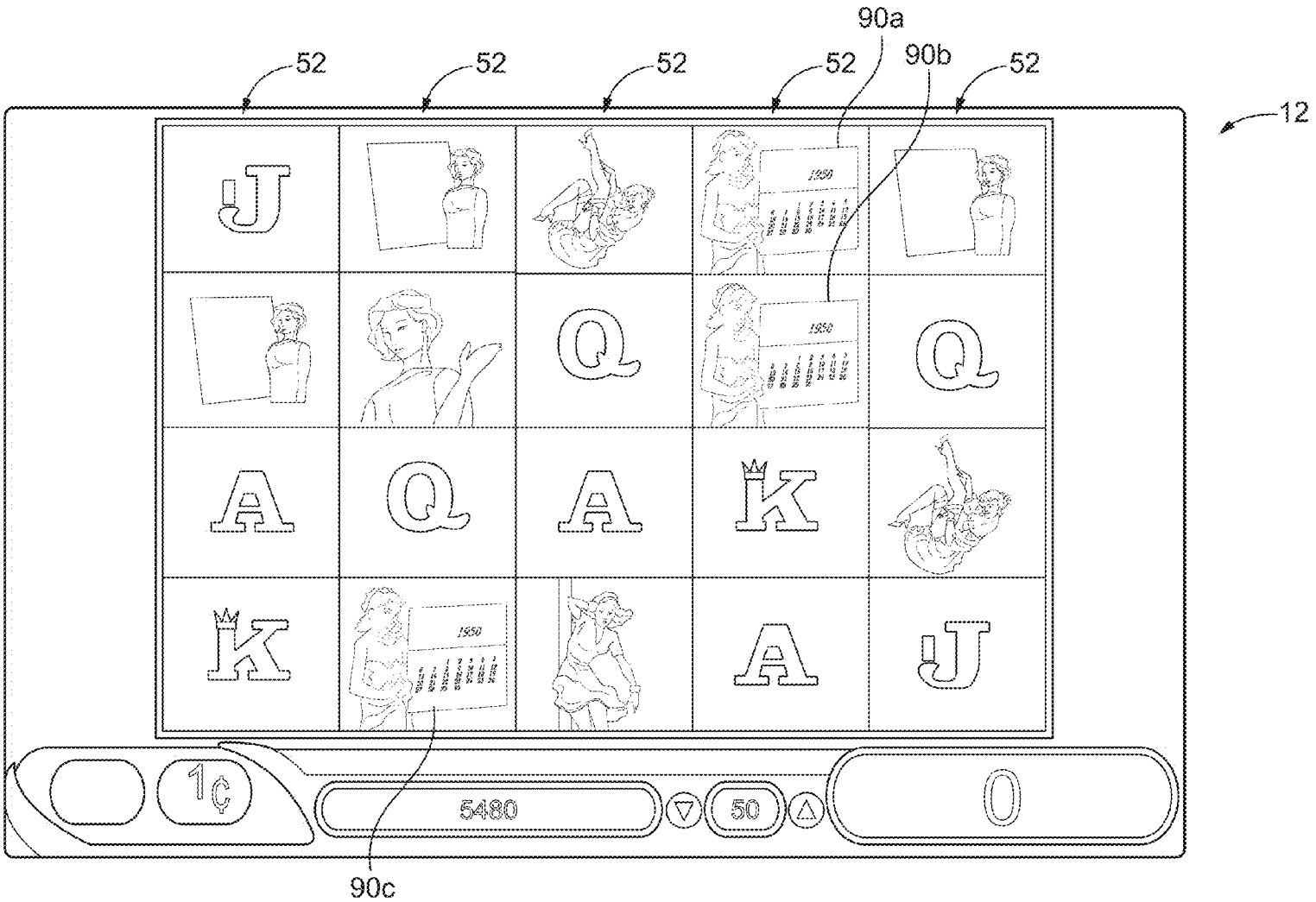
FIG. 8 is a screen shot of the display region of the wagering game subsequent to FIG. 7, illustrating the filling of transparent symbol positions on the fourth reel.

In FIG. 8, the background symbol 80 is now used to fill the two transparent symbol positions 70 on the fourth reel 52 that are located within the game outcome region. Accordingly, the reel symbols 90*a* and 90*b* are "filled" into those two transparent symbol positions 70 and the game outcome is evaluated with the two reel symbols 90*a* and 90*b* added to the symbol array. It should be noted that the selected background symbol 80 is an enlarged version of one of the fixed reel symbols 90*c* (i.e., the "Woman-Holding-Calendar" symbol) that is shown on the second reel 52 such that the symbol-filling process in FIG. 8 results in a symbol array having three of the same "Woman-Holding-Calendar" symbols 90*a*, 90*b*, 90*c*. The background symbol 80 does not necessarily need to be an enlarged version of one of the reel symbols, but can have a variety of configurations. The symbol array is evaluated for awards such that the two newly filled symbols 90*a* and 90*b* associated with the background symbol 80 can contribute to payline-based awards and/or scatter-pay awards.

Because the two reel symbols 90*a* and 90*b* are the identical symbol, a "clump" of symbols is created within the game outcome region due to the fact that the transparent symbol positions 70 are adjacent to each other. As used herein, the term "clump" or "symbol clump" refers to the same symbol occupying two or more symbol positions that are located immediately adjacent to one another on a single reel strip. In an alternative configuration, a clump may comprise a single, elongated or enlarged symbol (not shown) that occupies two or more adjacent symbol positions on a single reel. In yet a further alternate arrangement, a clump may comprise one or more elongated symbols, alone or in combination with one or more standard-sized symbols that occupy numerous symbol positions that are all immediately adjacent one another on a single reel. It should be noted that the "clump" of symbols may comprise symbols that have been filled into the transparent symbol positions 70 and an adjacent fixed symbol(s) that was already present on the reel strip 62 adjacent to the group of transparent symbol positions 70.

Because the player understands that the transparent symbol locations 70 are adjacent to each other and will be filled with an identical symbol, the rotation of the reels 52 through the game outcome region causes the player to experience a heightened level of entertainment and excitement because the player senses that he or she has a better chance of achieving a winning outcome. This is especially true if the transparent symbol locations 70 of the multiple reels 52 are close to stopping within the game outcome region because the symbol array will then include a disproportionately larger number of the symbols corresponding to the background symbol 80. Furthermore, when the background symbol 80 is selected from a subset of reel symbols that are considered to be the more beneficial symbols from the perspective of the player, there is an enhanced level of excitement because the opportunity for multiple beneficial symbols (e.g., the "WILD" symbol, the "BONUS" symbol, and high-payout symbols) to be present with the game outcome region is increased. From the perspective of the game manufacturer, the use of the background symbol 80 to fill the transparent symbol positions 70 on the reels 52 provides flexibility in designing different game mechanics that can be used during the wagering game to help maintain player interest.

Figure 9:
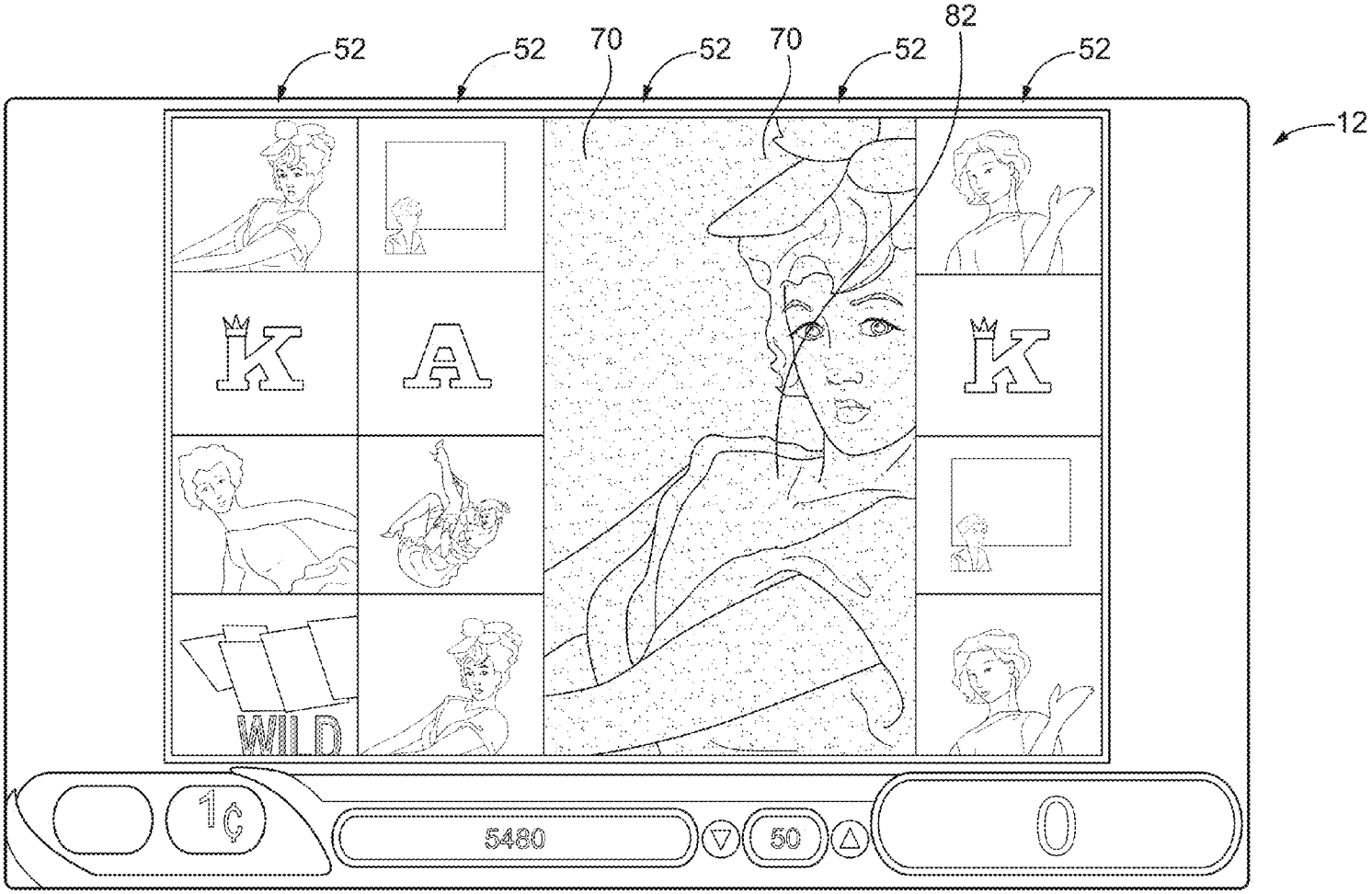
FIG. 9 is a screen shot of the display region of another play of the wagering game that utilizes simulated reels having reel strips like those in FIG. 4.

FIG. 9 illustrates a different game play of the wagering game relative to FIGS. 5-8. As shown in FIG. 9, the reels 52 are in motion such that the transparent symbol positions 70 on the third and fourth reels 52 are located within the game outcome region of the primary display 12. In the game play associated with FIG. 9, a different background symbol 82 has been selected relative to the background symbol 80 of FIGS. 5-8. Here, the background symbol 82 is a "Reclining Woman" symbol, which is an enlarged symbol corresponding to one of the reel symbols as can be seen in the top symbol position of the first reel 52 or the bottom symbol position of the second reel 52.

Figure 10:
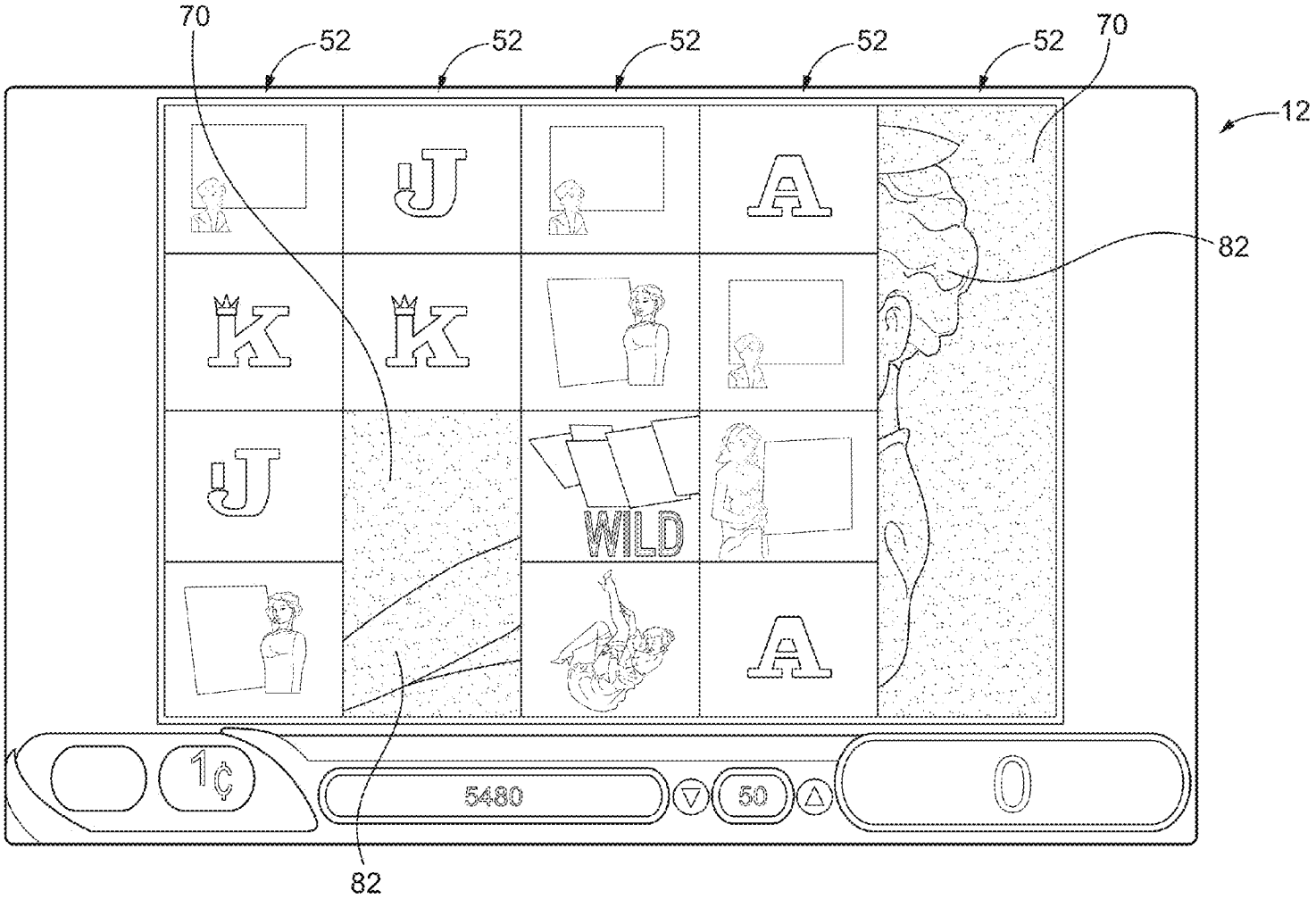
FIG. 10 is a screen shot of the display region of the wagering game that occurs after the screen shot of FIG. 9.
Figure 11:
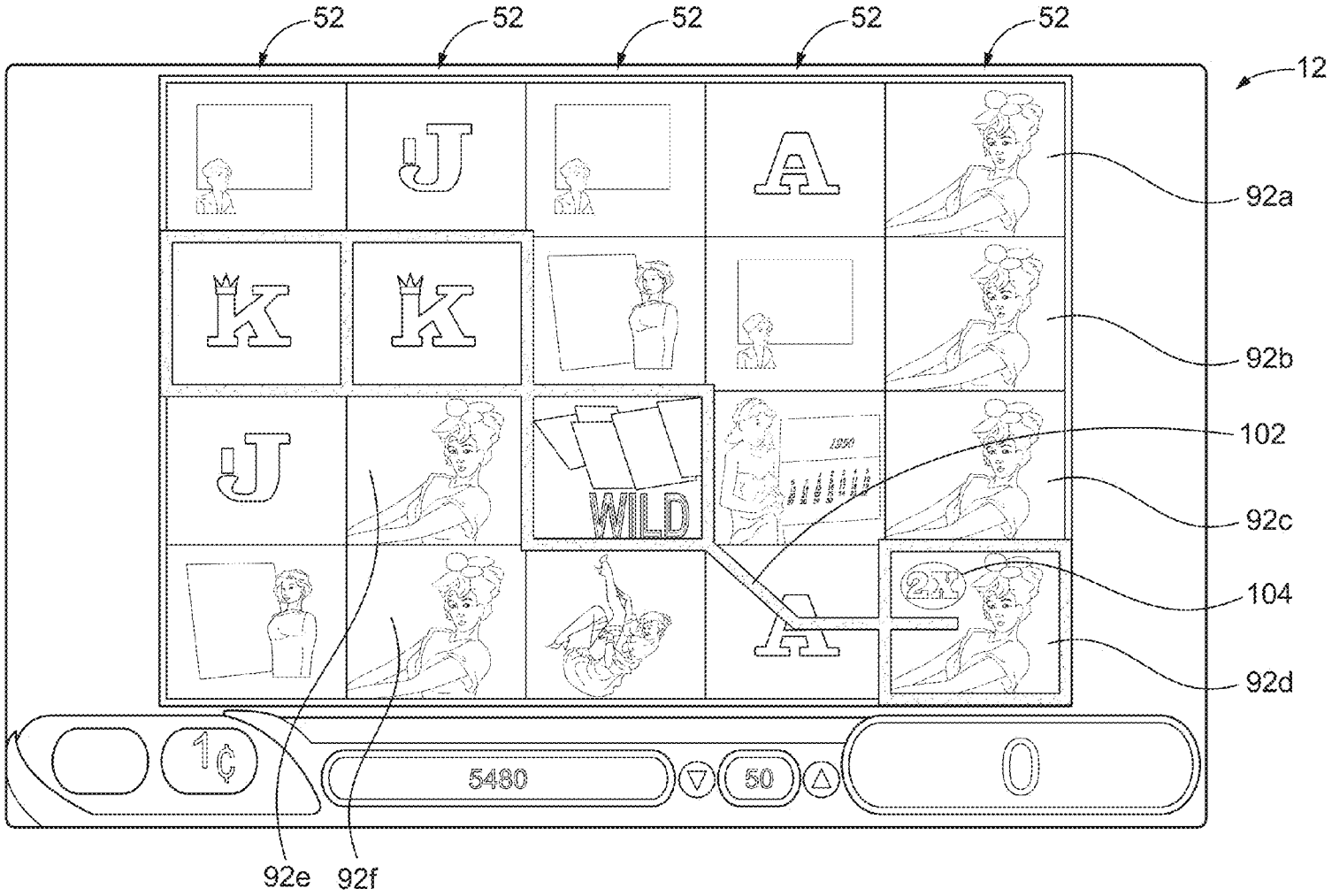
FIG. 11 is a screen shot of the display region of the wagering game subsequent to FIGS. 9 and 10, illustrating the filling of transparent symbol positions on the second and fifth reel.

FIG. 10 illustrates the reels 52 after subsequent motion relative to FIG. 9 and the reels 52 have now stopped. The background symbol 82 is revealed to the player through the transparent symbol positions 70 on the second and fifth reels 52. As shown in FIG. 11, the six transparent symbol locations 70 on the second and fifth reels 52 are now filled with the reel symbol 92*a*, 92*b*, 92*c*, 92*d*, 92*e*, 92*f* (i.e., the "Reclining Woman" symbol) that corresponds to the background symbol 82. The symbol array is then evaluated to determine any awards to be provided to the player.

FIG. 11 also illustrates a winning symbol combination located along a highlighted pay line 102 that extends across the symbol array, including the filled reel symbol 92*d* located on the fifth reel 52. In one alternative embodiment illustrated with regard to FIGS. 9-11, the filled reel symbols 92*a*, 92*b*, 92*c*, 92*d*, 92*e*, 92*f* may be associated with a game enhancement parameter 104, which provides the player with a more beneficial outcome. Here, the filled reel symbol 92*d* is associated with a "2× multiplier" game enhancement parameter 104, which causes the award associated with the winning outcome along the highlighted pay line 102 to be multiplied by two. The game enhancement parameter 104 may be associated with only a portion of the enlarged background symbol 82 and that portion may be identified to the player through some type of additional animation that is revealed to the player through the transparent symbol positions 70. For example, the portion of the background symbol 82 associated with the game enhancement parameter 104 may be animated in a flashing "gold" color, or include alphanumeric animation, such as a vibrating red "2×" symbol. In yet a further alternative, the game enhancement parameter 104 may be a mystery position that is only revealed after the reels 52 have stopped their movement. While the illustrated embodiment includes a "2× multiplier" game enhancement parameter 104, the game enhancement parameter may provide other game enhancements, such as an award of credits or an invitation to a bonus game. Additionally, the background symbol 82 may have different portions with different game enhancement parameters, and different types of background symbols may be more or less likely to include game enhancement parameters. The inclusion of the game enhancement parameter in association with the background symbol 82 may also be a function of the wager amount by the player. To the extent a game enhancement parameter is randomly selected, its random selection could occur through a second RNG process after the random selection of the background symbol 82 that is to be used for that particular game play.

In any embodiment using a game enhancement parameter in conjunction with the background symbol 82, to the extent that a portion of the background symbol 82 associated with the game enhancement parameter is located under a fixed symbol on the reel (as opposed to a transparent symbol position 70 where it would be useful), the player could be informed of the location of that portion through a more subtle animation located underneath the fixed symbol such that the fixed symbol is superimposed over it. In this situation, the player understands the symbol position at which he or she would have benefited from that game enhancement parameter had the transparent symbol position 70 stopped over it.

In addition to or in lieu of the background symbol 82 having the ability to enhance a game outcome, the transparent symbol positions 70 could also be associated with game enhancement parameters. As an example, during a single game play, one or more (or perhaps all) of the transparent symbol positions 70 could have a flashing colored border or a tinted color to indicate that a game enhancement parameter is associated with those transparent symbol positions 70. If that transparent symbol position 70 stops within the game outcome region and is associated with the winning outcome, the game enhancement parameter could be used to enhance the award associated with that winning outcome, as described above. The transparent symbol position(s) 70 that has the associated game enhancement parameter can be randomly selected prior to each game play. As indicated above, the type of game enhancement parameters can also be randomly selected from a group of possible game enhancement parameters, such as multipliers, credit awards, invitation to bonus games, free plays, etc. As a further example, multiple types of game enhancement parameters are associated with different ones of the transparent symbol positions 70 on a single game play.

Figure 12:
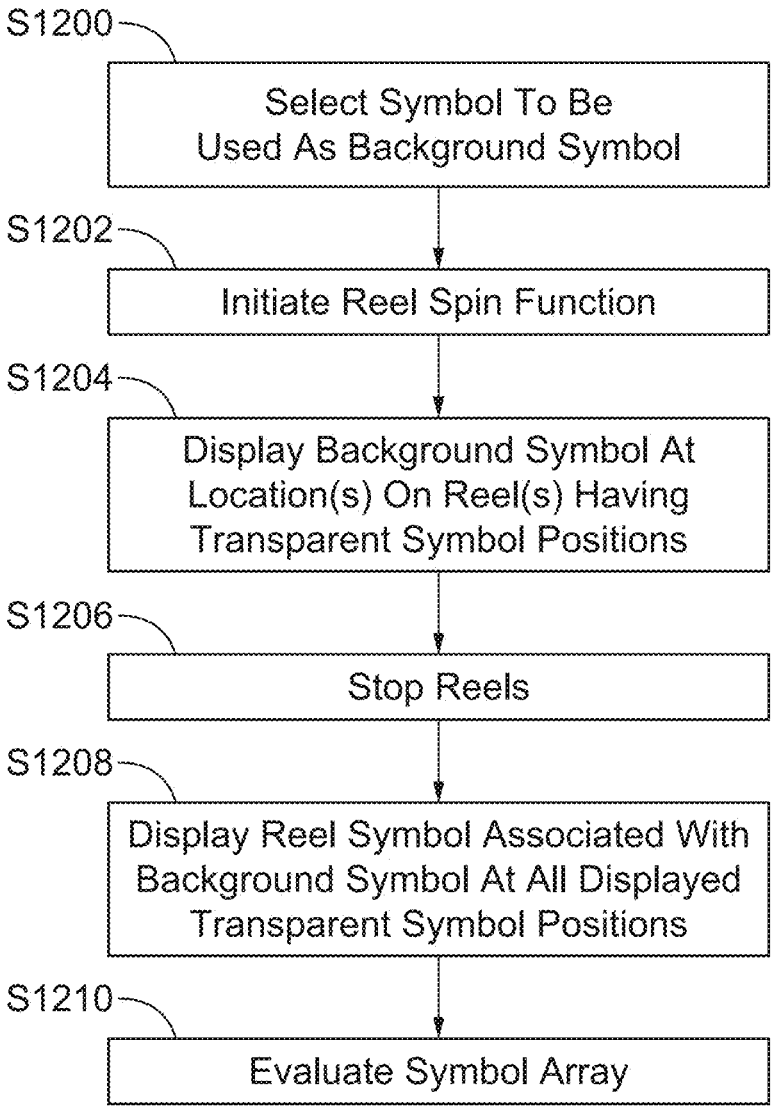
FIG. 12 is a flowchart for an exemplary method or algorithm that can correspond to instructions that can be stored on one or more non-transitory computer-readable media and can be executed by one or more controllers in accord with aspects of the disclosed concepts.

FIG. 12 illustrates one algorithm that could be used to implement the aforementioned processes within a gaming system. At step S1200, the background symbol is selected for use during that particular play of the wagering game. At step S1202, the reel spin function is initiated. The selected background symbol is then displayed at step S1204 such that, while the reels 52 undergo the simulated spinning motion, the transparent symbol positions 70 will reveal at least portions of the selected background symbol to the player.

At step S1206, the simulated spinning motion of the reels 52 is stopped. When this occurs, the background symbol may be revealed to the player through the now-static transparent symbol positions 70. At step S1208, the transparent symbol positions 70 located within the game outcome region are filled with (i.e., replaced with) a reel symbol that corresponds to the background symbol such that the displayed array of symbols within the game outcome region includes the newly added reel symbols, oftentimes creating a "clump" of identical symbols. Finally, at step S1210, the symbol array is evaluated to determine if the player has achieved a winning outcome.

While the evaluation for awards has been described thus far in terms of payouts for winning symbol combinations along active pay lines or scatter payouts, the present invention is also conducive to another type of award mechanism in which multiple identical symbols must be present on adjacent reels to achieve an award. In one example, five or more bonus symbols must appear on adjacent reels to achieve the bonus award. The bonus symbols do not necessarily need to be adjacent symbols located on the adjacent reels; rather the five bonus symbols must be present on adjacent reels. Accordingly, if (i) two bonus symbols are present on the first reel 52, (ii) two bonus symbols are present on the second reel 52, (iii) no bonus symbol is present on the third reel 52, (iv) one bonus symbol is present on fourth reel, and (v) two bonus symbols are present on the fifth reel 52, then there is no bonus that is activated because there are not five or more bonus symbols on adjacent reels. However, if (i) two bonus symbols are present on the first reel 52, (ii) three bonus symbols are present on the second reel 52, and (iii) no bonus symbol is present on the third, fourth, or fifth reels 52, then a bonus is awarded because there are five bonus symbols on the first and second reels 52. Because the present invention provides for the potential "clumping" of the same type of symbol (which could be the bonus symbol described above), the present invention may provide additional opportunities to have five or more bonus symbols appear on adjacent reels to trigger this type of award.

In any of the embodiments, additional visual effects may be used to highlight the newly added symbols to the player. Increased brightness on the added symbols, flashing or blinking regions on the added symbols, and/or borders surrounding all or parts of the added symbols are just a few of the ways to highlight the newly added symbols to the player. Furthermore, the transparent symbol positions 70 do not necessarily need to be transparent through their entire regions, but only a portion thereof. For example, a thin rectangular border can be used to help identify each of the transparent symbol positions 70 as they move through the game outcome region.

In the illustrated embodiments, the background symbol 80, 82 has been described relative to the game play associated with a base game of the wagering game. However, the present invention is not limited to base games, but can also be used in various secondary or bonus games. Additionally, while the selection of the background symbol 80, 82 has been described relative to a random selection process, the selection of background symbol 80, 82 could be scripted (i.e., the selection process cycles through a sequence of background symbols to be used on each play) in a way that would be extremely difficult for a player to be aware of the script. Alternatively, the player may be aware of the scripting sequence used to select the background symbol 80, 82 such as in a situation where the present invention is used in a bonus game having multiple free plays, and the player knows which of the background symbols 80, 82 will be used for each play of the multiple free plays in that bonus game. In this latter embodiment, the background symbol 80, 82 used for each play of the bonus game may be progressively more beneficial to the player than the previous play, such that the last free plays of the bonus game include high-value background symbols to provide the player with an enhanced opportunity for achieving high awards.

The background symbol 80, 82 has been described thus far as a single symbol located in the game outcome region. However, it is possible to divide the game outcome region into two or more sections, and each section has a different background symbol. In this alternative embodiment, for each game play, the creation of different types of symbol "clumps" is possible on the reels 52 because a first background symbol is used to fill any transparent symbol positions 70 on a first subset of the reels 52 while a second background symbol is used to fill any transparent symbol positions 70 on a second subset of the reels 52.

In a further alternative, the static background symbol 80, 82 may be replaced with moving background symbols (e.g., undergoing horizontal movement generally perpendicular to the vertical movement of the reels 52) such that the player visualizes a scrolling movement of various possible background symbols. The movement of the background symbols could occur before, during, or after the movement of the reels 52. Because the transparent symbol positions 70 only occupy a portion of each of the real strips 62*a*-62*e*, it may be best to have the movement of the background symbols occur before or after the movement of the reels to ensure that the player can better visualize the background symbols. As an example, three selected background symbols can horizontally move through the game outcome region and can be visualized by the player through the transparent symbol positions 70. Each of the selected background symbols has an enlarged size that is equivalent to the overall size of the symbol array. Once the horizontal movement has stopped, one of the three moving background symbol located within the game outcome region is the established background symbol for that game play. In a further alternative, once the movement stops, if two of the three selected background symbols are within the game outcome region (i.e., splitting the game outcome region into two sections), those two background symbols located within the game outcome region are used to fill the transparent symbol positions 70. It is also possible for the player to provide an input (e.g., via a "stop" input button) that causes the moving background symbols to stop, which allows the player to at least have some input into the final selection of the background symbol. In these embodiments, the moving background symbols used for each play are selected from a larger subset of symbols that could be used as background symbols.

Any of the methods described herein can include machine readable instructions for execution by: (a) a processor, (b) a controller, and/or (c) any other suitable processing device. Any algorithm, software, or method disclosed herein can be embodied in software stored on a tangible medium such as, for example, a flash memory, a CD-ROM, a floppy disk, a hard drive, a digital versatile disk (DVD), or other memory devices, but persons of ordinary skill in the art will readily appreciate that the entire algorithm and/or parts thereof could alternatively be executed by a device other than a controller and/or embodied in firmware or dedicated hardware in a well known manner (e.g., it may be implemented by an application specific integrated circuit (ASIC), a programmable logic device (PLD), a field programmable logic device (FPLD), discrete logic, etc.). Also, some or all of the machine readable instructions represented in any flowchart depicted herein may be implemented manually. Further, although specific algorithms are described with reference to flowcharts depicted herein, persons of ordinary skill in the art will readily appreciate that many other methods of implementing the example machine readable instructions may alternatively be used. For example, the order of execution of the blocks may be changed, and/or some of the blocks described may be changed, eliminated, or combined.

While many preferred embodiments and best modes for carrying out the present invention have been described in detail above, those familiar with the art to which this invention relates will recognize various alternative designs and embodiments for practicing the invention within the scope of the appended claims.

What is claimed is:

1. A gaming system primarily dedicated to playing a casino wagering game, comprising:

a gaming cabinet for housing components associated with the casino wagering game;

an electronic display device disposed on the gaming cabinet;

an electronic input device disposed on the gaming cabinet, the electronic input device configured to receive a physical input from a player to initiate the casino wagering game and transform the input into an electronic data signal;

a random element generator configured to generate one or more random elements; and one or more controllers configured to:

initiate the casino wagering game in response to the electronic data signal from the electronic input device;

determine an outcome of the casino wagering game based, at least in part, on the one or more random elements;

direct the electronic display device to display a background and a game outcome region superimposed over the background, the game outcome region being formed by a plurality of simulated reels, each reel including a respective plurality of first positions and at least one of the reels including a respective plurality of second positions, the first positions being occupied by respective symbols, the second positions being initially transparent;

randomly select a symbol from a plurality of possible symbols to be a background symbol that occupies the background;

spin the plurality of simulated reels such that at least a portion of the selected background symbol is revealed through the initially transparent second positions as the initially transparent second positions spin through the game outcome region;

stop the plurality of simulated reels;

after stopping the plurality of simulated reels, direct the electronic display device to display the selected background symbol at each of the second positions that is in the game outcome region when the reels are stopped; and award a tangible award based on the symbols in the game outcome region.

2. The gaming system of claim 1, wherein the at least one reel having the plurality of second positions includes each of the plurality of simulated reels such that each of the plurality of simulated reels includes the second positions that are initially transparent.

3. The gaming system of claim 1, wherein the plurality of second positions includes adjacent symbol positions such that the display of the selected background symbol creates a clump of identical symbols.

4. The gaming system of claim 3, wherein the number of adjacent symbol positions is greater than or equal to a maximum number of symbol positions in the game outcome region for the at least one of the reels such that, during some portions of the spinning, only the selected background symbol is revealed through the at least one of the reels and no respective symbols are present on the at least one of the reels.

5. The gaming system of claim 1, wherein the selected background symbol is an enlarged version of one of the symbols within the first positions, the selected background symbol extending across multiple symbol positions within the game outcome region.

6. The gaming system of claim 5, wherein the selected background symbol extends across all symbol positions within the game outcome region.

7. The gaming system of claim 6, wherein the display of the selected background symbol at each second position includes (i) terminating the displaying of the enlarged selected background symbol and (ii) initiating a displaying of a reel symbol corresponding to the enlarged background symbol within each second position that is in the game outcome region.

8. The gaming system of claim 1, wherein the plurality of possible symbols from which the background symbol is selected includes at least some of the symbols occupying the first positions.

9. The gaming system of claim 1, wherein adjacent ones of the reels have respective ones of the initially transparent second positions simultaneous move through the game outcome region, thereby creating a unitary large window to reveal a substantial portion of the background symbol.

10. The gaming system of claim 1, wherein the random element generator and the game-logic circuitry reside within the gaming cabinet.

11. The gaming system of claim 1, further including a value input device disposed on the gaming cabinet and configured to accept a tangible medium to fund the casino wagering game.

12. A gaming system primarily dedicated to playing a casino wagering game, comprising:

a gaming cabinet for housing components associated with the casino wagering game;

an electronic display device disposed on the gaming cabinet, the electronic display device including a plurality of simulated reels, each of the plurality of simulated reels having a plurality of symbol positions, the plurality of symbol positions including first symbol positions with reel symbols thereon and second symbol positions with initially transparent regions;

an electronic input device disposed on the gaming cabinet, the electronic input device configured to receive a physical input from a player to initiate the casino wagering game and transform the input into an electronic data signal;

a random element generator configured to generate one or more random elements; and one or more controllers configured to:

initiate the casino wagering game in response to the electronic data signal from the electronic input device;

determine an outcome of the casino wagering game based, at least in part, on the one or more random elements;

select one of the reel symbols to serve as a background symbol;

direct the electronic display device to display a game outcome region through which the plurality of simulated reels move;

while the simulated reels are moving, reveal, on the electronic display device, the background symbol through the initially transparent regions of the second symbol positions that move through the game outcome region;

for each of the plurality of simulated reels that have stopped moving, fill each of the second symbol positions located within the game outcome region with the reel symbol corresponding to the background symbol; and award a tangible award based on the symbols in the game outcome region.

13. The gaming system of claim 12, wherein the filling of each of the second symbol positions with the background symbol occurs simultaneously for each of the plurality of simulated reels.

14. The gaming system of claim 12, wherein the award is based on a pay line extending through one of the second symbol positions that has been filled with the reel symbol corresponding to the background symbol.

15. The gaming system of claim 12, wherein the filling of each of the second symbol positions includes (i) terminating the displaying of the selected background symbol and (ii) displaying, via the electronic display device, the reel symbol corresponding to the background symbol within the second symbol positions.

16. The gaming system of claim 12, wherein the background symbol is an enlarged version of the selected reel symbol, the enlarged background symbol extending across multiple symbol positions within the game outcome region.

17. The gaming system of claim 16, wherein the enlarged background symbol extends across all symbol positions within the game outcome region such that portions of the enlarged background symbol are temporarily revealed while the initially transparent regions of the second symbol positions move through the game outcome region.

18. The gaming system of claim 17, wherein at least one of the portions of the enlarged background symbol is associated with a game enhancement parameter, and the award is enhanced in response to one of the simulated reels stopping such that one of the second symbol positions is located over the portion associated with the game enhancement parameter.

19. The gaming system of claim 12, wherein the second symbol positions on at least some of the plurality of simulated reels are adjacent symbol positions, the filling of the second positions creating a clump of identical symbols in the adjacent symbol positions.

20. The gaming system of claim 12, wherein the random element generator and the game-logic circuitry reside within the gaming cabinet.

21. A method of operating a gaming system primarily dedicated to playing a casino wagering game, the gaming system including a gaming cabinet, a random element generator, one or more controllers, an electronic display device, and an electronic input device, the electronic display device disposed on the gaming cabinet, the electronic input device being disposed on the gaming cabinet, the electronic game display displaying a plurality of simulated reels, each of the plurality of simulated reels having a plurality of symbol positions, the plurality of symbol positions including first symbol positions with reel symbols thereon and second symbol positions with initially transparent regions, the method comprising:

generating one or more random elements with the random element generator;

receiving, via a physical input to the electronic input device, a wager input to initiate the casino wagering game;

determining, by the one or more controllers, an outcome of the casino wagering game based, at least in part, on the one or more random elements;

selecting, by the one or more controllers, one of the reel symbols to serve as a background symbol;

displaying, on the electronic display device, a game outcome region through which the plurality of simulated reels move;

while the simulated reels are moving, revealing, on the electronic display device, the background symbol through the initially transparent regions of the second symbol positions that move through the game outcome region;

for each of the plurality of simulated reels that have stopped moving, filling, by the one or more controllers, each of the second symbol positions located within the game outcome region with the reel symbol corresponding to the background symbol; and awarding, by the one or more controllers, a tangible award based on the symbols in the game outcome region.

22. The method of claim 21, wherein the selected background symbol is an enlarged version of the one of the reel symbols.

23. The method of claim 21, wherein the reel symbols filled into the second symbol positions create a clump of symbols.

24. The method of claim 21, wherein, for at least one reel, the number of adjacent second symbol positions is greater than or equal to a maximum number of symbol positions in the game outcome region such that, during some portions of the spinning of the at least one reel, only the selected background symbol is revealed through the at least one reel and no respective symbols are present on the at least one reel.

25. The method of claim 21, wherein the one or more processors randomly selects the background symbol from a plurality of possible symbols.

26. The method of claim 21, wherein the background symbol is a bonus-game symbol that may trigger the activation of a bonus game.

27. A method of operating a gaming system primarily dedicated to playing a casino wagering game, the gaming system including a gaming cabinet, a random element generator, one or more controllers, an electronic display device, and an electronic input device, the electronic display device disposed on the gaming cabinet, the electronic input device being disposed on the gaming cabinet, the electronic display device displaying a plurality of simulated reels, each of the reels having a plurality of symbol positions, the method comprising:

generating one or more random elements with the random element generator;

receiving, via a physical input to the electronic input device, a wager input to initiate the casino wagering game;

determining, by the one or more controllers, an outcome of the casino wagering game based, at least in part, on the one or more random elements;

selecting, via the one or more controllers, a symbol located on one of the plurality of reels to be the background symbol;

displaying, on the electronic display device, the selected background symbol behind a game outcome region;

displaying, within the game outcome region on the electronic display device, the plurality of simulated reels in movement and superimposed over the displayed background symbol such that only portions of the displayed background symbol are revealed to the player through transparent symbol positions located on the plurality of simulated reels;

filling, via the one or more controllers, the transparent symbol positions located within the game outcome region with the reel symbol corresponding to the background symbol; and awarding, via the one or more controllers, an award based on the filled reel symbols in the game outcome region.

28. The method of claim 27, wherein the filling includes creating a first clump of identical symbols on at least one of the reels.

* * * * *